US005913719A

United States Patent [19]

Hasegawa et al.

[11] Patent Number: 5,913,719

[45] Date of Patent: Jun. 22, 1999

[54] WORKPIECE HOLDING MECHANISM

[75] Inventors: Fumihiko Hasegawa; Makoto Kobayashi; Fumio Suzuki, all of Nishishirakawa, Japan

[73] Assignee: Shin-Etsu Handotai Co., Ltd., Tokyo, Japan

[21] Appl. No.: 08/798,459

[22] Filed: Feb. 10, 1997

[30] Foreign Application Priority Data

Feb. 21, 1996 [JP] Japan ..... 8-058299

[51] Int. Cl.[6] ..... B24B 41/06

[52] U.S. Cl. ..... 451/364; 451/397; 451/287

[58] Field of Search ..... 451/364, 397, 451/285, 287, 288, 540, 548, 390, 398, 402, 28, 41, 63, 57

[56] References Cited

U.S. PATENT DOCUMENTS

| | | | |
|---|---|---|---|
| 4,918,869 | 4/1990 | Kitta | 451/288 |
| 5,036,630 | 8/1991 | Kaanta et al. | 451/288 |
| 5,081,795 | 1/1992 | Tanaka et al. | 451/288 |
| 5,230,184 | 7/1993 | Bukhman . | |
| 5,335,453 | 8/1994 | Baldy et al. . | |
| 5,449,316 | 9/1995 | Strasbaugh | 451/287 |
| 5,573,448 | 11/1996 | Nakazima et al. | 451/287 |
| 5,584,746 | 12/1996 | Tanaka et al. | 451/288 |
| 5,588,902 | 12/1996 | Tominaga et al. | 451/288 |
| 5,643,053 | 7/1997 | Shendon | 451/288 |
| 5,670,011 | 9/1997 | Togawa et al. | 451/288 |

FOREIGN PATENT DOCUMENTS

| | | | |
|---|---|---|---|
| 0650806 | 5/1995 | European Pat. Off. . | |
| 2677293 | 12/1992 | France . | |
| 362024962 | 2/1987 | Japan | 451/288 |
| 363052967 | 3/1988 | Japan | 451/288 |
| 5-69310 | 3/1993 | Japan . | |
| 5-74749 | 3/1993 | Japan . | |

*Primary Examiner*—David A. Scherbel
*Assistant Examiner*—Derris Holt Banks
*Attorney, Agent, or Firm*—Oliff & Berridge, PLC.

[57] ABSTRACT

A workpiece holding mechanism is used for holding a wafer. The wafer is sandwiched between a holding plate of the workpiece holding mechanism and a polishing pad attached to a polishing turn table. The workpiece is pressed against the polishing pad with a predetermined pressure so that the bottom surface of the wafer is polished. Water is confined within a fluid confinement space defined between an elastic membrane and the holding plate so as to press the wafer via the elastic membrane. There is provided a volume adjustment screw that can be advanced toward the fluid confinement space and be retracted therefrom. Through adjustment of the screw, the elastic membrane is caused to have a flat surface, so that the elastic member is in close contact with the entire surface of the wafer. A holding membrane made of polyurethane foam is bonded to the surface of the elastic membrane, and a template is bonded to the surface of the holding membrane so as to improve the holding performance. Accordingly, a uniform pressure can be applied onto the wafer during polishing, and the wafer is prevented from shifting from a desired position even when polishing is performed at a high speed.

8 Claims, 4 Drawing Sheets

WORKPIECE HOLDING MECHANISM

BACKGROUND OF THE INVENTION

1. Field of the Invention

The present invention relates to an improvement of a holding mechanism for holding, for example, a semiconductor wafer while the wafer is being polished.

2. Description of the Related Art

Conventionally, in relation to a technique for polishing one face of a wafer of silicon, which is a typical semiconductor material, there has been known a polishing method and apparatus as disclosed, for example, in Japanese Patent Application Laid-Open (kokai) No. 5-74749. In the method and apparatus, a wafer is placed on a polishing turn table, such that the wafer surface to be polished is in contact with polishing pad attached onto the top surface of the polishing turn table. While the wafer is pressed downward by a top ring, the polishing turn table is moved along a small circular path to thereby cause the wafer to be polished by the polishing pad. In order to ensure that the wafer is polished over the entire area thereof under a uniform pressure, the wafer is pressed via a fluid. That is, an elastic membrane is attached onto the bottom surface of the top ring, and the fluid is confined in a fluid confinement space formed above the elastic membrane. Thus, while the elastic membrane is brought in close contact with the wafer, a pressing force is applied to the wafer to thereby press the wafer under a uniform pressure over the entire area thereof.

This conventional polishing method solves problems involved in a so-called wax method in which a wafer is attached onto a glass plate provided on the bottom surface of the top ring by using wax and processed. That is, since the elastic membrane absorbs ruggedness of the wafer surface, there is prevented the formation of dimples during polishing which would otherwise be caused by dust or the like caught between the glass plate and the wafer, the work and cost of applying wax are eliminated, and the work and cost of removing wax from the wafer and the glass plate after polishing are also eliminated.

However, the above-described technique does not have a function of finely adjusting the volume or pressure of the fluid confined in the fluid confinement space. As a result, the elastic membrane fails to assume a precisely flat shape, resulting in a failure to closely contact the wafer over the entire area thereof. This insufficient contact between the elastic membrane and the wafer causes an applied pressure to vary depending on a position on the wafer surface while the wafer surface is being polished, resulting in a failure to uniformly polish the wafer surface over the entire area thereof. For example, the amount of polishing differs between the peripheral area and the central area on the wafer surface, resulting in excessive removal or insufficient removal of material at the peripheral portion of the polished wafer.

Also, due to an insufficient force of holding a wafer, when a polishing rate is increased too much, a shift of the wafer results. This restrains the polishing rate, and thus a polishing efficiency is relatively low.

Thus, there has been eager demand for measures for finely adjusting the volume or pressure of a confined fluid to thereby establish close contact between an elastic membrane and a wafer over the entire area of the wafer so as to uniformly apply a pressure to the entire wafer surface, as well as for maintaining the wafer at a predetermined position even when the polishing rate is increased.

SUMMARY OF THE INVENTION

The present invention has been accomplished in view of the above-mentioned problems, and an object of the present invention is to provide a workpiece holding mechanism which can apply a uniform pressure on, for example, a semiconductor wafer while the wafer is polished, and which can prevent the wafer from shifting from a desired portion even when polishing is performed at a high speed.

The present invention provides a workpiece holding mechanism which includes a holding plate for uniformly pressing a workpiece against a polishing tool while the surface of the workpiece is being polished by the polishing tool. The holding plate includes an elastic membrane attached to a front face thereof so as to define a fluid confinement space, and a volume adjustment member for adjusting the volume of the fluid confinement space.

As the volume of the fluid confinement space is varied by the volume adjustment member after the fluid confinement space is filled with a fluid, the elastic membrane deforms outward and inwards. While the surface flatness of the elastic membrane is measured, the volume of the fluid confinement space is adjusted such that the elastic membrane has a complete surface flatness. This adjustment allows the elastic membrane to closely contact the workpiece over the entire area thereof. When the workpiece is pressed while being in close contact with the elastic membrane, the workpiece is pressed uniformly via the confined fluid (Pascal's law). Thus, the polished surface can be finished flat.

The volume adjustment member is, for example, an adjusting screw whose tip is inserted into the fluid confinement space. Through advance and retreat of the adjustment member, the volume of the fluid confinement space is adjusted.

Preferably, a holding membrane is attached to the front surface of the elastic membrane to thereby enhance the function of holding the workpiece.

The holding membrane is made, for example, of polyurethane foam and functions to increase the force of holding the workpiece, thereby preventing the workpiece from changing its orientation.

Preferably, a template is attached to the front surface of the elastic membrane or the holding membrane to thereby prevent the workpiece from shifting.

Since the workpiece is held within the template while being polished, the workpiece does not shift beyond the elastic membrane even when the polishing rate is increased.

Through combined use of the holding membrane and the template, the workpiece is held more firmly, so that it is prevented from shifting out of the surface of the elastic membrane. Accordingly, for example, even when the workpiece has a circular shape, the workpiece is prevented from rotating within the template.

DESCRIPTION OF THE PREFERRED EMBODIMENT

An embodiment of the present invention will now be described with reference to the drawings.

Figure 1:
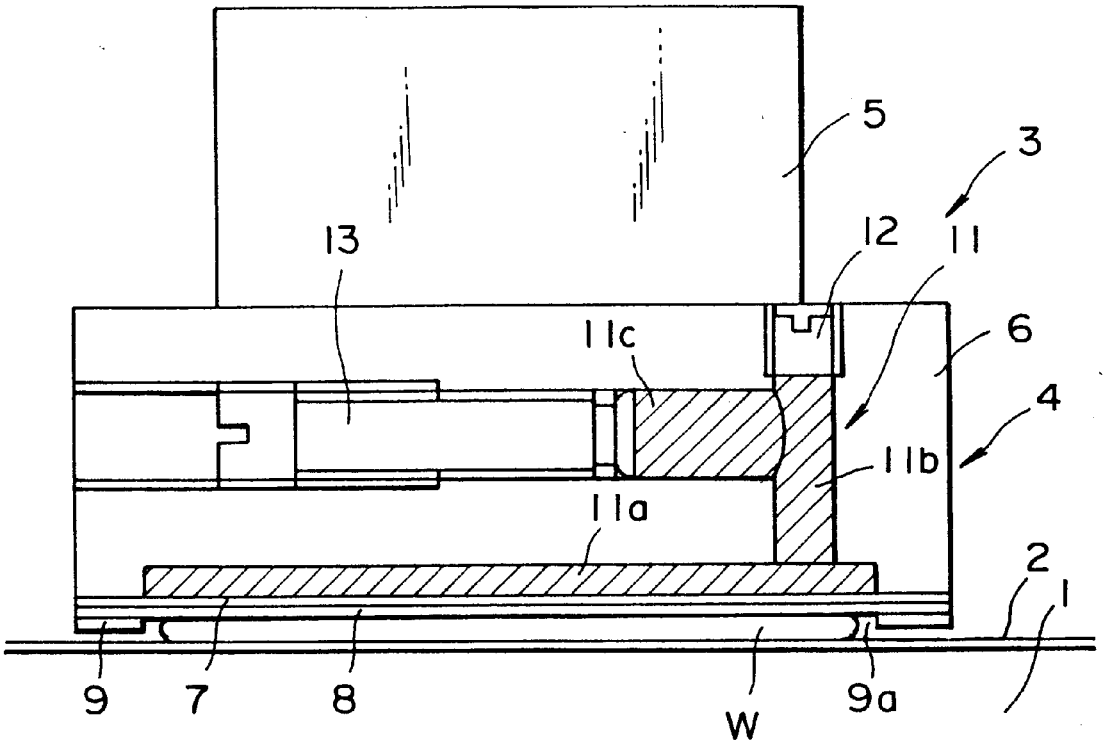
FIG. 1 is a partial view of a top ring of a polishing apparatus to which a holding mechanism of the present invention is applied.

A workpiece holding mechanism of the present invention is applied to a polishing apparatus for polishing one side of a wafer in a wafer manufacturing process. As shown in FIG. 1, a wafer W is sandwiched between a top ring 3 and a polishing pad 2 that is attached to a polishing turn table 1, as a polishing tool. While polishing agent is being fed to the polishing pad 2, the polishing turn table 1 is rotated, for example, along a small circular path to thereby polish the bottom surface of the wafer W.

The top ring 3 includes a holding mechanism 4 for holding the wafer W and a weight 5 that is placed on the holding mechanism 4 so as to press the wafer W. The holding mechanism 4 is composed of a holding plate 6, an elastic membrane 7 bonded to the bottom surface of the holding plate 6, a holding membrane 8 bonded to the bottom surface of the elastic membrane 7, and a template 9 bonded to the holding membrane 8.

A fluid confinement space 11 is formed inside the holding plate 6. The fluid confinement space 11 includes a reservoir space 11*a* formed in the bottom surface of the holding plate 6 and having a predetermined depth, a vertical bore 11*b* for supplying an incompressible fluid such as water into the reservoir space 11*a*, and a horizontal bore 11*c* which communicates with the vertical bore 11*b* at an intermediate position thereof. The reservoir space 11*a* is covered with the elastic membrane 7 on at least the bottom side thereof.

The reservoir space 11*a* is engraved into a circular shape having a diameter, for example, of about 100 to 102% of the diameter of the wafer W.

A plug 12 is screwed into an upper end of the vertical bore 11*b* to thereby confine a charged fluid. A volume adjustment screw 13 is screwed into an inlet end of the horizontal bore 11*c* in a manner such that the volume adjustment screw 13 can be advanced and retracted. As the volume adjustment screw 13 advances into the horizontal bore 11*c*, the volume of the fluid confinement space 11 decreases. On the contrary, as the volume adjustment screw 13 retreats toward the exterior of the horizontal bore 11*c*, the volume of the fluid confinement space 11 increases.

The holding membrane 8 is made, for example, of polyurethane foam. When the holding membrane 8 is pressed against the wafer W, the upper surface of the wafer W is held by the holding membrane 8 as if it were sucked by the holding membrane 8.

The template 9 is provided with a hole 9*a* having substantially the same shape as that of the wafer W inserted within the hole 9*a* and is adapted to prevent the wafer W from shifting.

The total thickness of the holding membrane 8 and the template 9 is relatively thin such that even when the holding membrane 8 is pressed against the wafer W, the bottom surface of the wafer W projects downward from the bottom surface of the template 9.

Referring to FIG. 2, the method of adjusting the holding mechanism 4 will next be described.

Figure 2A:
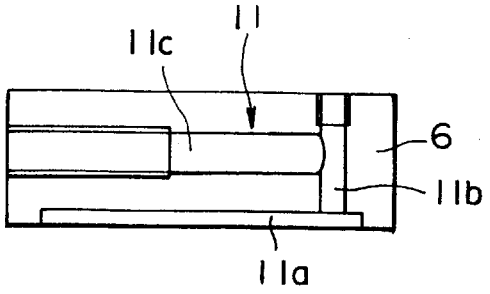
FIGS. 2A to 2E are diagrams illustrating steps of setting the holding mechanism before polishing is started.

First, as shown in FIG. 2A, the holding plate 6 is prepared. In the holding plate, there is already formed the fluid confinement space 11 composed of the reservoir space 11*a*, the vertical bore 11*b*, and the horizontal bore 11*c*.

Figure 2B:
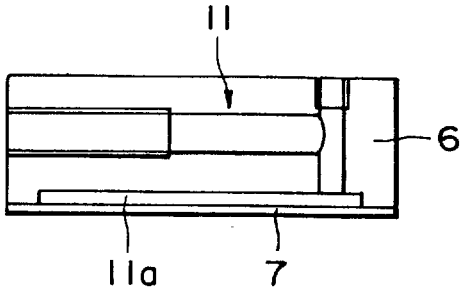
Figure 2C:
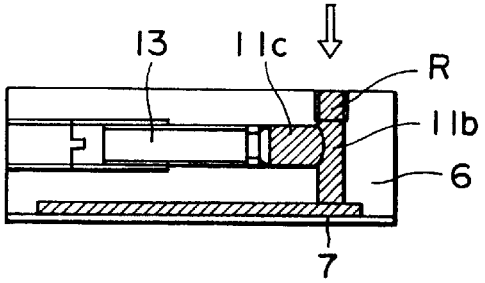

Next, as shown in FIG. 2B, the elastic membrane 7 is bonded to the bottom surface of the holding plate 6 to cover the bottom opening of the reservoir space 11*a*. Then, as shown in FIG. 2C, the volume adjustment screw 13 is screwed into the horizontal bore 11*c* from the inlet end thereof as deep as to a neutral position, thereby stopping the horizontal bore 11*c*. Subsequently, a fluid such as water R is fed into the fluid confinement space 11 from the top end of the vertical bore 11*b*. After the fluid confinement space 11 is filled with water R, the top end of the vertical bore 11*b* is plugged with the plug 12.

Figure 2D:
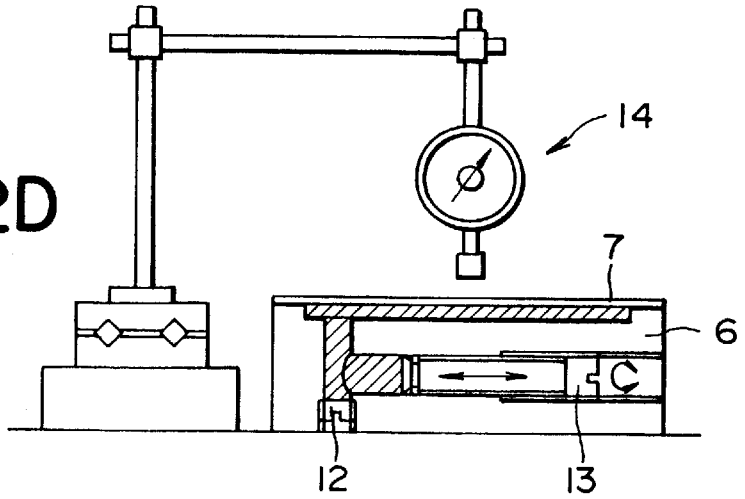

Then, as shown in FIG. 2D, the holding plate 6 is turned upside down. While the surface flatness of the elastic membrane 7 is being measured by a flatness measuring tool 14, the volume adjustment screw 13 is advanced and retreated to thereby make the surface of the elastic membrane 7 flat.

Figure 2E:
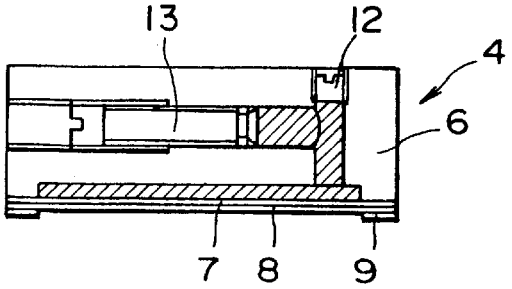

When this adjustment is completed, the volume adjustment screw 13 is fixed. Subsequently, as shown in FIG. 2E, the holding membrane 8 is bonded onto the surface of the elastic membrane 7, and then the template 9 is bonded onto the surface of the holding membrane 8, thus completing the assembly of the holding mechanism 4.

A weight 5 is mounted on the top surface of the thus-prepared holding mechanism 4 to thereby form the top ring 3. As shown in FIG. 1, the wafer W is placed on the polishing pad 2 of the polishing turn table 1 and positioned within the hole 9*a* in the template 9. The thus-set wafer W is polished while being pressed under a predetermined pressure by the weight 5.

In this case, the template 9 prevents the wafer W from shifting from a predetermined position, and the holding membrane 8 holds the wafer W such that the wafer W does not rotate within the template 9. Accordingly, it is possible to polish the wafer W at a relatively high rate, thereby improving polishing efficiency.

It is confirmed that the relation between the shape of the elastic membrane 7 and the shape of the polished wafer W becomes as shown in FIG. 4.

Figure 4A:
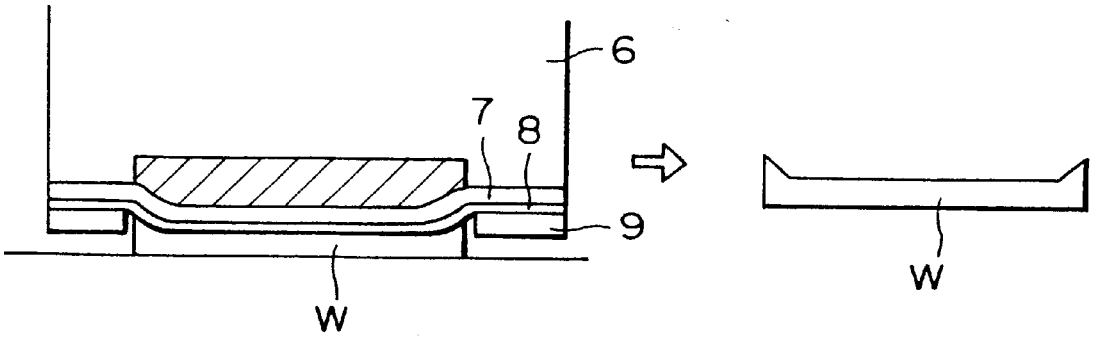
FIGS. 4A to 4C are diagrams illustrating the relation between the amount of charged fluid and the shape of a polished wafer.

That is, FIG. 4A shows a case where the elastic membrane 7 deforms outward due to an overcharge of water, and a resultant shape of the polished wafer W. When the fluid confinement space 11 is overcharged with water, the peripheral edge portion of the elastic membrane 7 at which the elastic membrane 7 is fixed to the holding plate 6 fails to contact the flat surface of the wafer W, resulting in a reduction in the pressing force at the peripheral edge portion. As a result, the peripheral portion of the polished wafer W projects beyond the rest as illustrated.

Figure 4B:
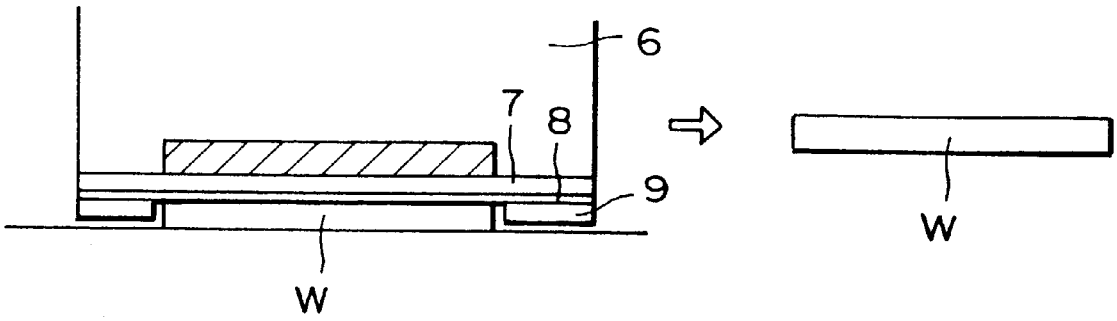
Figure 4C:
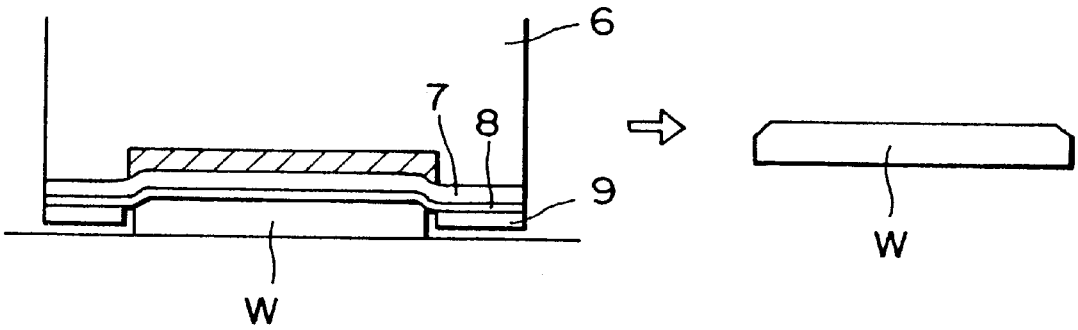

On the other hand, FIG. 4C shows a case where the elastic membrane 7 deforms inward due to an insufficient charge of water, and a resultant shape of the polished wafer W. When the fluid confinement space 11 is insufficiently charged with water, the pressing force decreases at the central portion of the elastic membrane 7, and increases at the peripheral edge portion thereof relative to the pressing force at the central portion. As a result, the amount of polishing decreases at the central portion of the wafer W, and relatively increases at the peripheral edge portion of the wafer W at which the elastic membrane 7 is fixed to the holding plate 6. Therefore, the peripheral portion of the polished wafer W is rounded off as illustrated.

By contrast, as shown in FIG. 4B, when the elastic membrane 7 maintains a flat surface because of a proper charge of a fluid, a load is uniformly applied onto the surface of the wafer W. As a result, the polished surface of the wafer W becomes flat.

Figure 3:
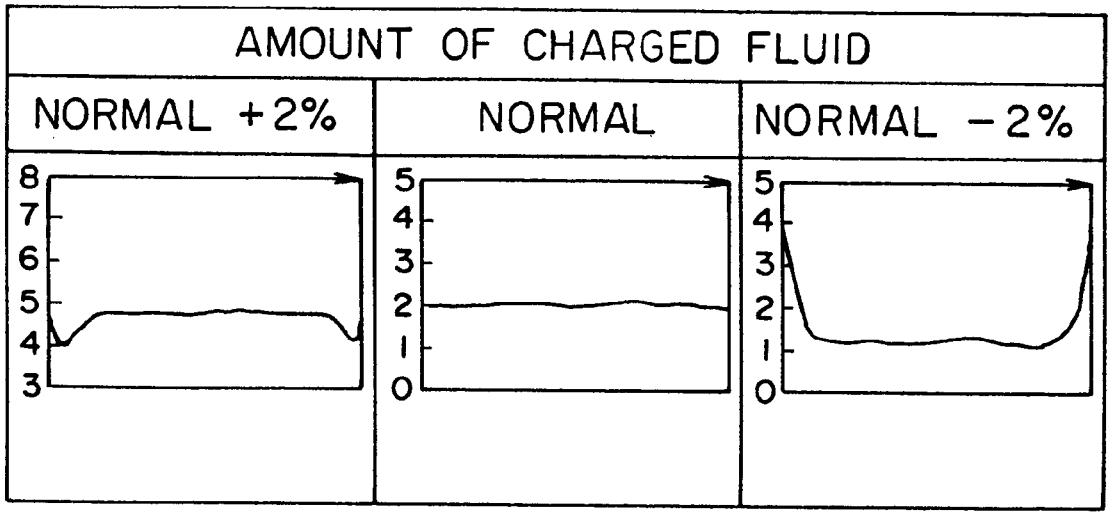
FIG. 3 is a graph illustrating an experimentally obtained relation between the amount of charged fluid and variation in the amount of polishing in a diametric direction.

FIG. 3 shows the result of an experiment in which variation in the amount of polishing along the diameter of a wafer was measured when the wafer was polished by a polishing apparatus to which the holding mechanism 4 of the present invention was applied. The measurement was performed for each of the following three cases: a case in which water was charged in a normal amount; a case in which water was charged in the normal amount +2%; and a case in which water was charged in the normal amount −2%, in all cases a pressure for processing being 250 g/cm$^2$. The results of the experiment show a tendency similar to that illustrated in FIG. 4, proving the abovedescribed tendency.

In the experiment of FIG. 3, the holding plate 6 is made of SUS (stainless steel), and the reservoir space 11*a* and the wafers used have a diameter of 200 mm.

In the present embodiment, the fluid confinement space 11 is filled with the water R. However, any other incompressible fluid may be used in place of the water R.

According to the present embodiment, a single workpiece is held by a single holding plate, i.e. a workpiece is polished in a so-called single-workpiece polishing system. However, each holding plate may have a plurality of fluid confinement spaces, each of which has a volume adjustment screw for adjusting the planar shape of an elastic membrane, to thereby polish a plurality of workpieces at a time (batch process).

What is claimed is:

1. A workpiece holding mechanism for uniformly pressing a workpiece against a polishing tool while a surface of the workpiece is being polished by the polishing tool, said workpiece holding mechanism comprising:

a holding plate having a front surface;

an elastic membrane attached to the front surface of said holding plate so as to define a fluid confinement space between said elastic membrane and said holding plate, said fluid confinement space being filled with an incompressible fluid; and a volume adjustment member movably connected to said holding plate and in fluid communication with said fluid confinement space wherein moving said volume adjustment member in a first direction increases the fluid confinement space and moving said volume adjustment member in a second direction opposite the first direction decreases said fluid confinement space.

2. A workpiece holding mechanism according to claim 1, further comprising a holding membrane capable of enhancing the workpiece holding performance of said holding plate and being attached to a front membrane surface of said elastic membrane.

3. A workpiece holding mechanism according to claim 2, further comprising a template capable of preventing a workpiece from shifting and being attached to the front surface of said holding membrane.

4. A workpiece holding mechanism according to claim 1, further comprising a template capable of preventing a workpiece from shifting and being attached to a front membrane surface of said elastic membrane.

5. A workpiece holding mechanism according to claim 1, wherein said volume adjustment member is a screw.

6. A workpiece holding mechanism according to claim 5, wherein the first direction is one of counter-clockwise and clockwise and the second direction is a remaining one of counter-clockwise and clockwise.

7. A workpiece holding mechanism according to claim 1, wherein said fluid confinement space includes a reservoir space, a vertical bore and a horizontal bore.

8. A workpiece holding mechanism according to claim 7, wherein said volume adjustment member is disposed within the horizontal bore.

* * * * *